US011724308B2

(12) United States Patent
Friebel et al.

(10) Patent No.: US 11,724,308 B2
(45) Date of Patent: Aug. 15, 2023

(54) REFRACTORY RING AND REFRACTORY RING SYSTEM AND METHODS FOR ASSEMBLING THE SAME

(71) Applicant: Refractory Intellectual Property GMBH & Co. KG, Vienna (AT)

(72) Inventors: G. Michael Friebel, Knoxville, TN (US); Pavan Shivaram, Towson, MD (US)

(73) Assignee: Refractory Intellectual Property GMBH & Co. KG

( * ) Notice: Subject to any disclaimer, the term of this patent is extended or adjusted under 35 U.S.C. 154(b) by 30 days.

(21) Appl. No.: 17/534,708

(22) Filed: Nov. 24, 2021

(65) Prior Publication Data

US 2022/0176445 A1 Jun. 9, 2022

Related U.S. Application Data

(60) Provisional application No. 63/121,582, filed on Dec. 4, 2020.

(51) Int. Cl.

| | |
|---|---|
| ***B22D 41/02*** | (2006.01) |
| ***F27D 1/00*** | (2006.01) |
| ***F27D 1/16*** | (2006.01) |

(52) U.S. Cl.

CPC ..... *B22D 41/02* (2013.01); *F27D 1/0006* (2013.01); *F27D 1/1621* (2013.01)

(58) Field of Classification Search

None

See application file for complete search history.

(56) References Cited

U.S. PATENT DOCUMENTS

| | | | |
|---|---|---|---|
| 2,526,725 | A | 10/1950 | Bronson |
| 2,757,036 | A | 7/1956 | Smith |
| 2,923,569 | A | 2/1960 | Milliron |
| 3,211,490 | A | 10/1965 | Gardner et al. |
| 3,339,966 | A | 9/1967 | Carlson |
| 3,401,973 | A | 9/1968 | Marshall |
| 3,424,488 | A | 1/1969 | Renfroe |

(Continued)

FOREIGN PATENT DOCUMENTS

| | | | |
|---|---|---|---|
| CN | 204438752 U | * | 7/2015 |
| CN | 106524756 A | | 3/2017 |

(Continued)

OTHER PUBLICATIONS

International Search Report and Written Opinion for International Application No. PCT/US2022/013510, dated Mar. 23, 2022, 13 pages.

*Primary Examiner* — Scott R Kastler
(74) *Attorney, Agent, or Firm* — RatnerPrestia

(57) ABSTRACT

A unitary refractory ring having a sidewall surrounding and spaced from a center axis, and one or more lifting lugs distributed around the center axis. The lifting lugs extend from an inner face of the sidewall towards the center axis, and are located between lower and upper axial faces of the sidewall. Each lifting lug has a lower lug face extending radially towards the center axis from the inner face of the sidewall, and a backing structure extending upwards along an axial direction from the lower lug face towards the upper axial face of the sidewall. An assembly of refractory rings, and methods for making and assembling refractory rings are also provided.

24 Claims, 10 Drawing Sheets

(56) References Cited

U.S. PATENT DOCUMENTS

| | | | |
|---|---|---|---|
| 3,800,853 | A | 4/1974 | Neumann et al. |
| 5,306,062 | A | 4/1994 | Dodge |
| 5,476,300 | A | 12/1995 | Dodge |
| 5,797,638 | A | 8/1998 | Yamazaki et al. |
| 5,879,616 | A | 3/1999 | Emy |
| 5,882,583 | A | 3/1999 | Emy |
| 6,042,165 | A | 3/2000 | Thompson |
| 6,673,306 | B2 | 1/2004 | Abrino et al. |
| 6,787,098 | B2 | 9/2004 | Abrino et al. |
| 7,056,469 | B2 | 6/2006 | Nosbisch |
| 8,764,082 | B2 | 7/2014 | Krogh et al. |
| 9,126,264 | B2 | 9/2015 | Moschini et al. |
| 9,126,265 | B2 | 9/2015 | Barrett |
| 9,616,496 | B2 | 4/2017 | Barrett |
| 9,663,330 | B2 | 5/2017 | Moeller et al. |
| 9,724,756 | B2 | 8/2017 | Barrett |
| 9,724,757 | B2 | 8/2017 | Barrett |
| 10,023,441 | B2 | 7/2018 | Meyer |
| 11,465,200 | B2 | 10/2022 | Emy et al. |
| 2002/0080846 | A1 | 6/2002 | Tanaka et al. |
| 2010/0117389 | A1 | 5/2010 | Poole |
| 2015/0069678 | A1 | 3/2015 | Barrett |
| 2015/0314994 | A1 | 11/2015 | Meyer |
| 2015/0360915 | A1 | 12/2015 | Barrett |
| 2016/0039002 | A1 | 2/2016 | Barrett |
| 2017/0304892 | A1 | 10/2017 | Barrett |
| 2022/0176445 | A1* | 6/2022 | Friebel ..... F27D 1/1621 |

FOREIGN PATENT DOCUMENTS

| | | | |
|---|---|---|---|
| CN | 110280749 | A | 9/2019 |
| DE | 102007035452 | A1 | 1/2009 |
| EP | 3608440 | A1 | 2/2020 |
| JP | 0631435 | A | 2/1994 |
| JP | 10246579 | A | 9/1998 |
| JP | 2000288718 | A | 10/2000 |
| WO | 02066915 | A1 | 8/2002 |

* cited by examiner

FIG. 3
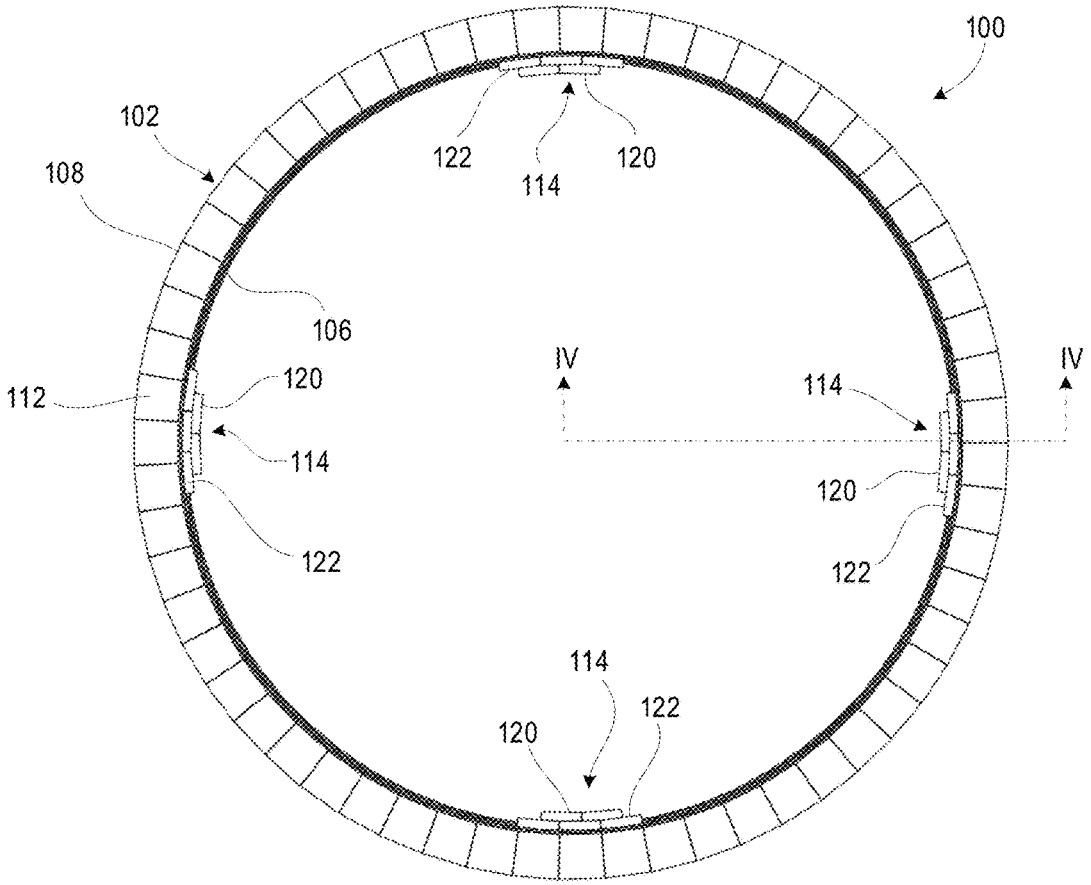
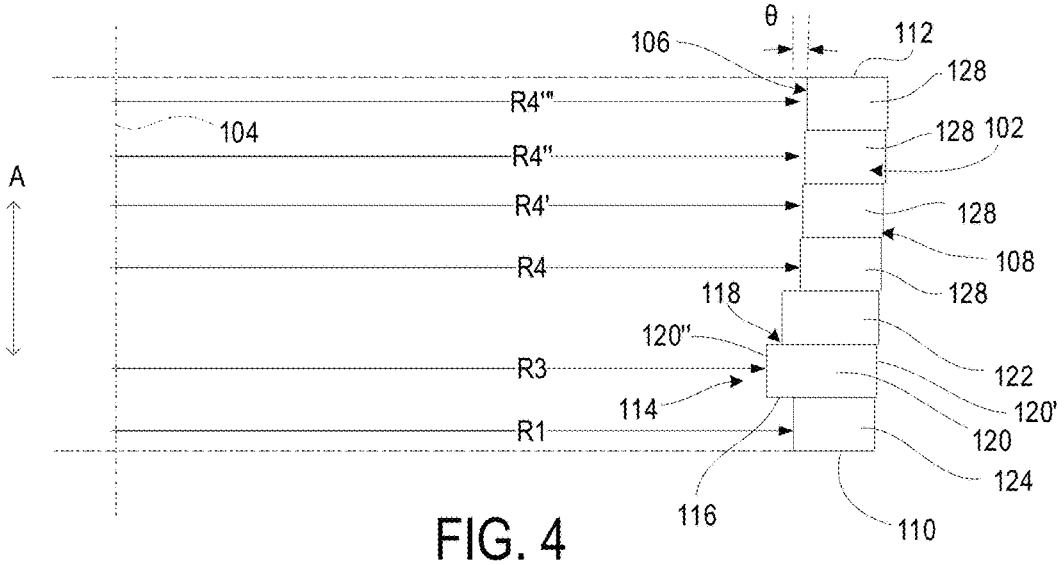
FIG. 4

FIG. 11
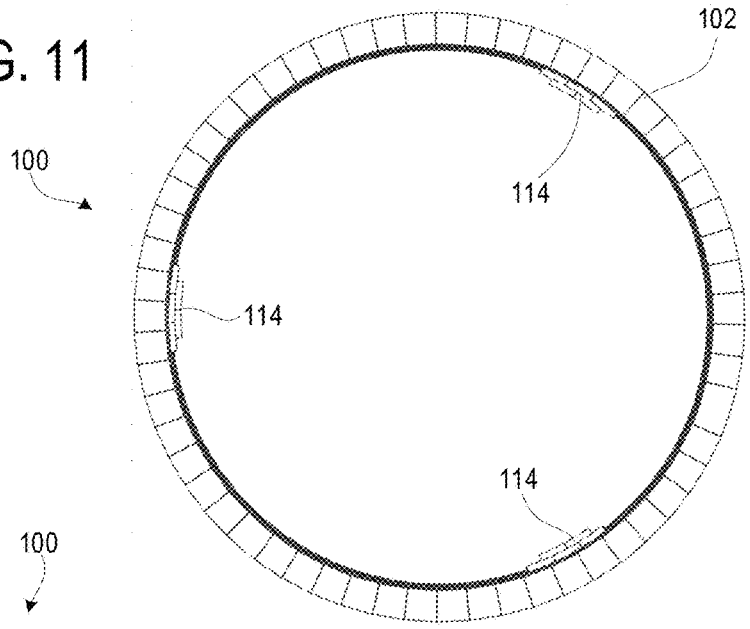
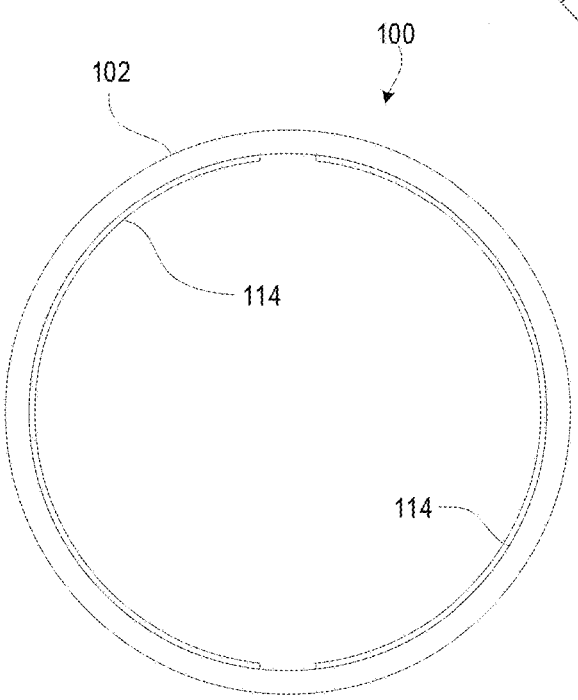
FIG. 12
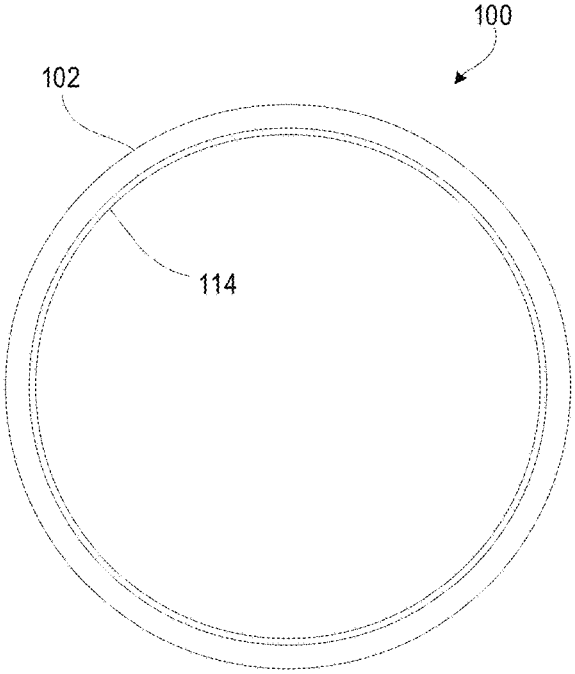
FIG. 13

REFRACTORY RING AND REFRACTORY RING SYSTEM AND METHODS FOR ASSEMBLING THE SAME

BACKGROUND TO THE INVENTION

The present invention is directed to refractory linings for ladles and other vessels that hold molten metal or other high temperature liquid materials. Refractory linings typically are provided in a two-layer format, with an outer refractory lining positioned adjacent to the wall of the ladle, and an inner refractory lining located inside the outer refractory lining. In use, the inner refractory lining is exposed to the molten metal, and experiences more wear than the outer refractory lining. Thus, the inner refractory lining typically requires replacement more frequently than the outer refractory lining. The inner refractory lining may be referred to as the "working" or "replaceable" lining, whereas the outer refractory lining might be referred to as the "permanent," "backup" or "safety" lining. While the outer lining is sometimes referred to as being "permanent," it can require periodic repair or replacement.

The process of installing an inner refractory lining—whether new or as a replacement—can be laborious. In a typical case, the inner refractory lining is assembled inside the ladle from individual bricks, which requires one or more workers to enter the ladle with the bricks to perform the assembly. This results in an ergonomically-unfriendly environment, and a potential injury hazard from the heavy load of movable bricks. Such installations are also time-consuming and it can be difficult to perform quality control on the final assembly.

It has been suggested to preassemble portions of the inner refractory lining into rings, which are then installed inside the ladle. For example, U.S. Pat. No. 9,126,265, which is incorporated by reference herein, describes forming monolithic rings of refractory material having cutouts along the lower surface or in the inner face of the ring, and inserting a lifting device into these cutouts to lower the ring into the ladle. However, the inventors have determined that the state of the art of preassembled refractory rings can still be improved.

SUMMARY OF THE INVENTION

In a first exemplary aspect, there is provided a unitary refractory ring comprising: a sidewall forming a continuous closed loop about a center axis extending in an axial direction, the sidewall being spaced from the center axis in a radial direction that is perpendicular to the axial direction, and having an inner face facing towards the center axis, and an outer face facing away from the center axis, the inner face and the outer face extending in the axial direction between a lower axial face at a bottom of the sidewall, and an upper axial face at a top of the sidewall; and one or more lifting lugs distributed around the center axis and extending from the inner face towards the center axis at respective locations along the axial direction between the lower axial face and the upper axial face, each of the one or more lifting lugs comprising a lower lug face extending radially towards the center axis from the inner face, and a backing structure extending upwards along the axial direction from the lower lug face towards the upper axial face.

In some exemplary aspects, the closed loop forms a circle as viewed along the axial direction.

In some exemplary aspects, at least a portion of the inner face or the outer face extends parallel to the axial direction to form a cylindrical shape.

In some exemplary aspects, at least a portion of the inner face or the outer face extends at an angle to the axial direction to form a frustoconical shape.

In some exemplary aspects, the outer face is dimensioned and shaped to match the size and shape of a corresponding outer liner of a ladle refractory lining.

In some exemplary aspects, the outer face is dimensioned and shaped to match the size and shape of a corresponding outer liner of a ladle refractory lining with a predetermined gap between the outer face and the outer liner.

In some exemplary aspects, each lower lug face extends orthogonally to the axial direction.

In some exemplary aspects, each lower lug face extends perpendicular to a portion of the inner face adjacent to the respective lower lug face.

In some exemplary aspects, the one or more lifting lugs comprises two or more lifting lugs.

In some exemplary aspects, the one or more lifting lugs comprises three or more lifting lugs.

In some exemplary aspects, the one or more lifting lugs comprises four or more lifting lugs.

In some exemplary aspects, the one or more lifting lugs comprises a plurality of lifting lugs distributed equidistantly around the center axis.

In some exemplary aspects, the backing structure of at least one lifting lug comprises a first portion adjacent to the lower lug face that extends a first distance from the inner surface, and a second portion between the first portion and the upper axial face that extends a second distance from the inner surface, the second distance being less than the first distance.

In some exemplary aspects, the first portion and the second portion extend parallel to a portion of the inner surface that is adjacent to the at least one lifting lug to thereby form a stepped structure.

In some exemplary aspects, the first portion comprises at least one first refractory brick partially embedded in the sidewall, and the second portion comprises at least one second refractory brick partially embedded in the sidewall.

In some exemplary aspects, at least one lifting lug comprises at least one first refractory brick that extends in the radial direction from a respective embedded end that is embedded in the sidewall to a respective cantilevered end that extends a first distance from an adjacent portion of the inner face of the sidewall to form the backing structure.

In some exemplary aspects, the embedded end of the refractory brick extends to and is flush with the outer face of the sidewall.

In some exemplary aspects, the lower lug face comprises a lower surface of the cantilevered end.

In some exemplary aspects, the sidewall comprises a monolithic structure to which the at least one first refractory brick is attached.

In some exemplary aspects, the sidewall comprises a plurality of second refractory bricks to which the at least one first refractory brick is attached.

In some exemplary aspects, the at least one refractory brick comprises a different refractory composition than the plurality of second refractory bricks.

In some exemplary aspects, at least one lifting lug comprises: one or more lower lug bricks extending a first distance from the inner surface; and one or more upper lug bricks located between the one or more lower lug bricks and the upper axial face, extending a second distance from the inner surface, with the one or more upper lug bricks being in contact with at least one of the one or more lower lug bricks.

In some exemplary aspects, the second distance is less than the first distance.

In some exemplary aspects, the one or more lower lug bricks comprises two lower lug bricks, and the one or more upper lug bricks comprises three upper lug bricks.

In some exemplary aspects, the sidewall and the one or more lifting lugs comprise a plurality of connected refractory bricks.

In some exemplary aspects, at least one lifting lug is monolithically formed with the sidewall.

In another exemplary aspect, there is provided a unitary refractory ring formed by interconnected refractory bricks, the unitary refractory ring comprising: a lower brick layer defined by a ring of lower bricks arranged at a first distance from a center axis; a lifting brick layer located above the lower brick layer with respect to an axial direction parallel to the center axis, the lifting brick layer being defined by: one or more lifting layer sidewall bricks arranged in one or more groups at a second distance from the center axis, and one or more lug bricks arranged in one or more groups at a third distance from the center axis, wherein the third distance is less than the second distance and the first distance, and wherein each of the one or more groups of lug bricks is located adjacent to a respective one of the one or more groups of lifting layer sidewall bricks; and an upper brick layer located above the lifting brick layer with respect to the axial direction, the upper brick layer being defined by a ring of upper bricks arranged at a fourth distance from a center axis.

In some exemplary aspects, the first distance is less than the second distance, and the second distance is less than the fourth distance.

In some exemplary aspects, the unitary refractory ring further comprises a backing brick layer located between the lifting brick layer and the upper brick layer, the backing brick layer being defined by: one or more backing layer sidewall bricks arranged in one or more groups at a fifth distance from the center axis; and one or more backing bricks arranged in one or more groups at a sixth distance from the center axis; wherein the sixth distance is less than the fifth distance, and greater than the third distance; and wherein each of the one or more groups of backing bricks are located adjacent to a respective one of the one or more groups of backing layer sidewall bricks and in direct contact with at least one of the one or more lug bricks.

In some exemplary aspects, the one or more lifting layer sidewall bricks comprises a plurality of lifting layer sidewall bricks arranged in two or more groups at the second distance from the center axis, the one or more lug bricks comprises a plurality of lug bricks arranged in two or more groups at the third distance from the center axis, and each of the two or more groups of lug bricks is located between a respective two of the two or more groups of lifting layer sidewall bricks.

In some exemplary aspects, the unitary refractory ring further comprises a backing brick layer located between the lifting brick layer and the upper brick layer, the backing brick layer being defined by: a plurality of backing layer sidewall bricks arranged in two or more groups at a fifth distance from the center axis; and a plurality of backing bricks arranged in two or more groups at a sixth distance from the center axis; wherein the sixth distance is less than the fifth distance, and greater than the third distance; and wherein each of the two or more groups of backing bricks are located between a respective two of the two or more groups of backing layer sidewall bricks and in direct contact with at least one of the plurality of lug bricks.

In some exemplary aspects, the lower bricks have a first thickness as measured along a radial direction that is orthogonal to the center axis, and the refractory ring further comprises: a bottom brick layer defined by a ring of bottom bricks arranged below and connected to the lower brick layer, wherein the bottom bricks have a second thickness as measured along the radial direction, the second thickness being greater than the first thickness.

In some exemplary aspects, the upper bricks have a third thickness as measured along a radial direction that is orthogonal to the center axis, and the refractory ring further comprises: a top brick layer defined by a ring of top bricks arranged above and connected to the upper brick layer, wherein the top bricks have a fourth thickness as measured along the radial direction, the fourth thickness being greater than the third thickness.

In another exemplary aspect, there is provided a method for assembling a unitary refractory ring, the method comprising: forming a lower brick layer defined by a ring of lower bricks arranged at a first distance from a center axis; forming a lifting brick layer located above the lower brick layer with respect to an axial direction parallel to the center axis, the lifting brick layer being defined by: one or more lifting layer sidewall bricks arranged in one or more groups at a second distance from the center axis, and one or more lug bricks arranged in one or more groups at a third distance from the center axis, wherein the third distance is less than the second distance and the first distance, and wherein each of the one or more groups of lug bricks is located adjacent to a respective one of the one or more groups of lifting layer sidewall bricks; forming an upper brick layer located above the lifting brick layer with respect to the axial direction, the upper brick layer being defined by a ring of upper bricks arranged at a fourth distance from a center axis; and joining the lower bricks, lifting layer sidewall bricks, lug bricks and upper bricks together to form a unitary structure.

In some exemplary aspects, the first distance is less than the second distance, and the second distance is less than the fourth distance.

In some exemplary aspects, each group of lug bricks comprises at least two refractory bricks.

In some exemplary aspects, forming the lower brick layer comprises individually laying each lower brick at a respective location; forming the lifting brick layer comprises individually laying each lifting layer sidewall brick and lug brick at a respective location; forming the upper brick layer comprises individually laying each upper brick at a respective location; and joining the lower bricks, lifting layer sidewall bricks, lug bricks and upper bricks comprises joining each individual one of the lower bricks, lifting layer sidewall bricks, lug bricks and upper bricks to one or more adjacent ones of the lower bricks, lifting layer sidewall bricks, lug bricks and upper bricks during individual laying of each of the lower bricks, lifting layer sidewall bricks, lug bricks and upper bricks at their respective location.

In some exemplary aspects, forming the lower brick layer comprises placing one or more groups comprising at least one of the lower bricks at a respective location and joining the lower bricks to form a unitary lower brick layer; forming the lifting brick layer comprises placing one or more groups comprising at least one of the lifting layer sidewall bricks and lug bricks at a respective location and joining the lifting layer sidewall bricks and lug bricks to form a unitary lifting brick layer; forming the upper brick layer comprises placing one or more groups comprising at least one of the upper bricks at a respective location and joining the upper bricks to form a unitary upper brick layer; and joining the lower brick layer, lifting brick layer and upper brick layer to form the unitary refractory ring.

In some exemplary aspects, the method further comprises: forming a backing brick layer located between the lifting brick layer and the upper brick layer, the backing brick layer being defined by: one or more backing layer sidewall bricks arranged in one or more groups at a fifth distance from the center axis, and one or more backing bricks arranged in one or more groups at a sixth distance from the center axis, wherein the sixth distance is less than the fifth distance, and greater than the third distance, and wherein each of the one or more groups of backing bricks are located adjacent to a respective group of backing layer sidewall bricks and in direct contact with at least one of the one or more lug bricks; and joining the backing bricks and backing layer sidewall bricks to one or more of the lower bricks, lifting layer sidewall bricks, lug bricks and upper bricks together to form a unitary structure.

In another exemplary aspect, there is provided a refractory ring system comprising: a first unitary refractory ring comprising: a first sidewall having a first inner face forming a continuous closed loop about a first center axis, the first sidewall being spaced from the first center axis and extending along the first center axis from a first sidewall lower edge to a first sidewall upper edge, wherein the first sidewall upper edge lies in a respective flat plane that is orthogonal to the first center axis, and a first group of one or more first lifting lugs distributed around the first center axis and extending from the first inner face towards the first center axis; a second unitary refractory ring comprising: a second sidewall having a second inner face forming a continuous closed loop about a second center axis, the second sidewall being spaced from the second center axis and extending along the second center axis from a second sidewall lower edge to a second sidewall upper edge, wherein the second sidewall lower edge lies in a respective flat plane that is orthogonal to the second center axis, and a second group of one or more second lifting lugs distributed around the second center axis and extending from the second inner face towards the second center axis; wherein the second sidewall lower edge is configured to mate with the first sidewall upper edge to form a first closed seam there between, with the second inner face flush with the first inner face at the first closed seam.

In some exemplary aspects, the first sidewall terminates at an upper surface that lies in the respective flat plane of the first sidewall upper edge, the second sidewall terminates at a lower surface that lies in the respective flat plane of the second sidewall lower edge, and the upper surface abuts the lower surface to form the first closed seam.

In some exemplary aspects, the first sidewall comprises at an upper radially-tapered surface that terminates at the first sidewall upper edge, the second sidewall comprises a lower radially-tapered surface that terminates at the second sidewall lower edge, and the upper radially-tapered surface abuts the lower radially-tapered surface to form the first closed seam.

In some exemplary aspects, each of the second lifting lugs comprises a respective lower lug face located between the second sidewall lower edge and the second sidewall upper edge.

In some exemplary aspects, each of the first lifting lugs comprises a respective lower lug face located between the first sidewall lower edge and the first sidewall upper edge.

In some exemplary aspects, the first sidewall lower edge lies in a respective flat plane that is orthogonal to the first center axis.

In some exemplary aspects, the first sidewall lower edge is configured to rest on a flat upper surface of a refractory ladle bottom.

In some exemplary aspects, the second sidewall upper edge lies in a respective flat plane that is orthogonal to the second center axis.

In some exemplary aspects, the refractory ring system further comprises: a third unitary refractory ring comprising: a third sidewall having a third inner face forming a continuous closed loop about a third center axis, the third sidewall being spaced from the third center axis and extending along the third center axis from a third sidewall lower edge to a third sidewall upper edge, wherein the third sidewall upper edge lies in a respective flat plane that is orthogonal to the third center axis, and a third group of one or more third lifting lugs distributed around the third center axis and extending from the third inner face towards the third center axis; wherein the third sidewall lower edge is configured to mate with the second sidewall upper edge to form a second closed seam therebetween, with the third inner face flush with the second inner face at the second closed seam.

In some exemplary aspects, the first sidewall is cylindrical and the second sidewall is cylindrical, and the first sidewall and the second sidewall have identical radial dimension.

In some exemplary aspects, the first sidewall tapers away from the first center axis from the first sidewall lower edge to the first sidewall upper edge, and the second sidewall tapers away from the second center axis from the second sidewall lower edge to the second sidewall upper edge.

In some exemplary aspects, at least one of: the one or more first lifting lugs comprises a first plurality of groups of one or more first lifting lugs; and the one or more second lifting lugs comprises a second plurality of groups of one or more second lifting lugs.

In another exemplary aspect, there is provided a method for assembling a refractory ring system, the method comprising: providing a first refractory ring comprising: a first sidewall having a first inner face forming a continuous closed loop about a first center axis, the first sidewall being spaced from the first center axis and extending along the first center axis from a first sidewall lower edge to a first sidewall upper edge, wherein the first sidewall upper edge lies in a respective flat plane that is orthogonal to the first center axis, and one or more first lifting lugs distributed around the first center axis and extending from the first inner face towards the first center axis; providing a second refractory ring comprising: a second sidewall having a second inner face forming a continuous closed loop about a second center axis, the second sidewall being spaced from the second center axis and extending along the second center axis from a second sidewall lower edge to a second sidewall upper edge, wherein the second sidewall lower edge lies in a respective flat plane that is orthogonal to the second center axis, and one or more second lifting lugs distributed around the second center axis and extending from the second inner face towards the second center axis, wherein the second sidewall lower edge is configured to mate with the first sidewall upper edge to form a first closed seam therebetween, with the second inner face flush with the first inner face at the first closed seam; placing the first refractory ring into a refractory ladle using the first plurality of lifting lugs; and placing the second refractory ring on top of the first refractory ring with the second sidewall lower edge in contact with the first sidewall upper edge to form the first closed seam.

In some exemplary aspects, placing the second refractory ring on top of the first refractory ring is performed with the second refractory ring at an arbitrary angular orientation about the second center axis.

In some exemplary aspects, the second sidewall upper edge lies in a respective flat plane that is orthogonal to the second center axis, and the method further comprises: providing a third refractory ring comprising: a third sidewall having a third inner face forming a continuous closed loop about a third center axis, the third sidewall being spaced from the third center axis and extending along the third center axis from a third sidewall lower edge to a third sidewall upper edge, wherein the third sidewall upper edge lies in a respective flat plane that is orthogonal to the third center axis, and one or more third lifting lugs distributed around the third center axis and extending from the third inner face towards the third center axis, wherein the third sidewall lower edge is configured to mate with the second sidewall upper edge to form a second closed seam therebetween, with the third inner face flush with the second inner face at the second closed seam; and placing the third refractory ring on top of the second refractory ring with the third sidewall lower edge in contact with the second sidewall upper edge to form the second closed seam.

In some exemplary aspects, placing the third refractory ring on top of the second refractory ring is performed with the third refractory ring at an arbitrary angular orientation about the third center axis.

In some exemplary aspects, at least one of: the one or more first lifting lugs comprises a first plurality of groups of one or more first lifting lugs; the one or more second lifting lugs comprises a second plurality of groups of one or more second lifting lugs; and the one or more third lifting lugs comprises a third plurality of groups of one or more third lifting lugs.

BRIEF DESCRIPTION OF THE DRAWINGS

The following drawings are provided to help explain embodiments described herein, and are not intended to limit the scope of the appended claims. Like reference numbers refer to like features.

FIG. 3 is a top plan view of the refractory ring of FIG. 1.

FIG. 4 is a partial section view of the refractory ring of FIG. 1, shown in elevation view along line IV-IV of FIG. 3, with background removed.

FIG. 11 is a top plan view of another exemplary embodiment of a refractory ring.

FIG. 12 is a top plan view of another exemplary embodiment of a refractory ring.

FIG. 13 is a top plan view of another exemplary embodiment of a refractory ring.

DESCRIPTION OF EMBODIMENTS

Figure 1:
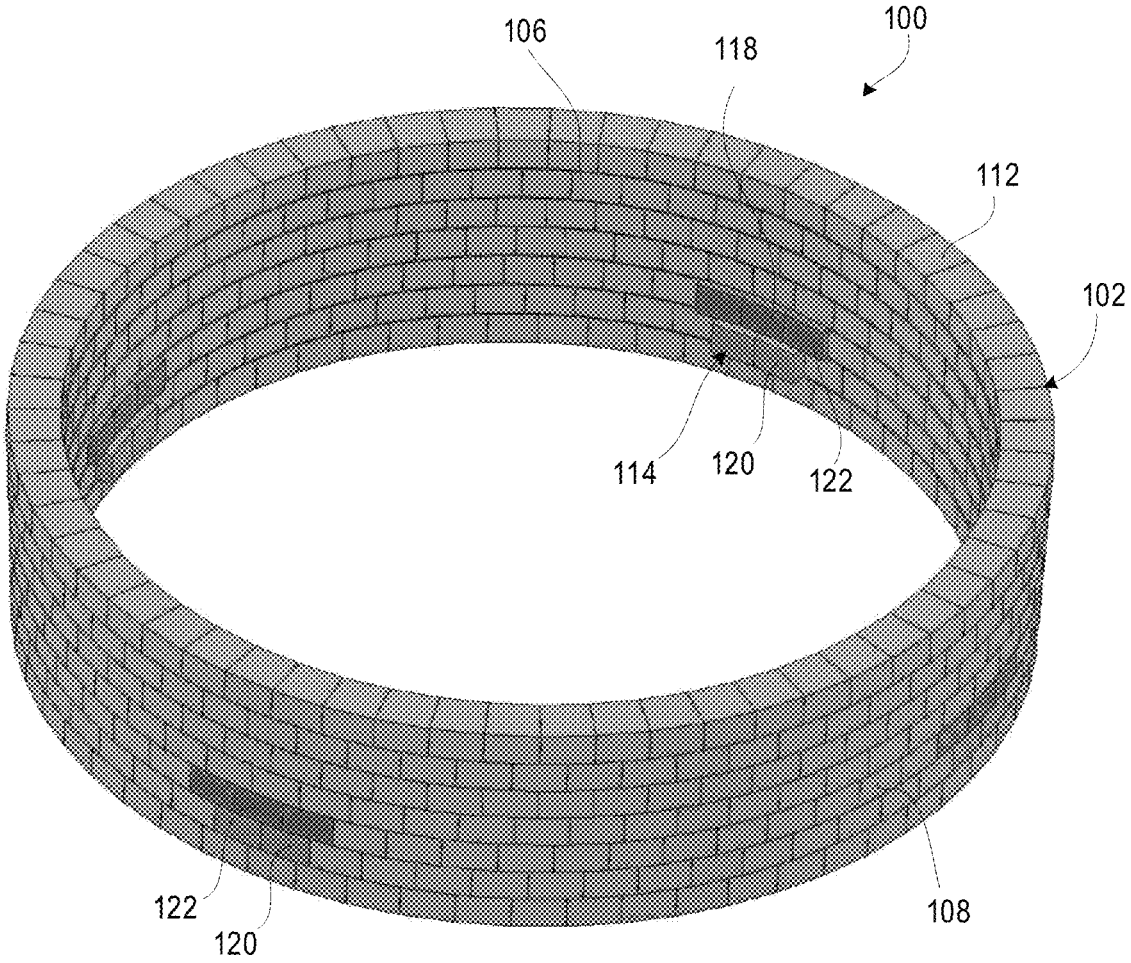
FIG. 1 is an isometric view of a first exemplary embodiment of a unitary refractory ring.

Embodiments described herein provide examples of inventions relating to refractory rings, refractory ring systems, and methods for making and assembling the same. It will be understood that these examples are not intended to limit what is claimed, and modifications may be made to these examples without departing from the scope of the appended claims.

A first exemplary embodiment of a unitary refractory ring 100 is illustrated in FIGS. 1-4. In general terms, the refractory ring 100 is a unitary part that can be manipulated as a unit for transportation and assembly into a refractory lining. As explained below, the refractory ring 100 may be formed using a variety of different construction techniques. In the example of FIGS. 1-4, the unitary refractory ring 100 is formed by an assembly of refractory bricks that are connected together to form a unitary structure.

The refractory ring 100 has a sidewall 102 that forms a continuous closed loop about a center axis 104 that extends in an axial direction A. The sidewall 102 is spaced from the center axis 104 in a radial direction that is perpendicular to the axial direction A. The sidewall 102 has an inner face 106 that faces towards the center axis 104, and an outer face 108 that faces away from the center axis 104. The inner face 106 and the outer face 108 extend along the axial direction between a lower axial face 110 at the bottom of the sidewall 102, and an upper axial face 112 at the top of the sidewall 102. In the shown embodiment, the lower axial face 110 and upper axial face 112 are flat surfaces extending orthogonally to the center axis 104. While this is preferred, other embodiments of upper axial faces 112 and lower axial faces 110 may include other shapes, such as helical starter ramps for aligning helical rows of bricks.

As shown in FIG. 3, the closed loop formed by the sidewall 102 has the shape of a circle as viewed along the axial direction A. However, other embodiments may have other shapes, such as elliptical shapes, half circles joined by straight sections, and so on.

The inner face 106 and outer face 108 also may have any operable shape with respect to the axial direction A. In the example of FIGS. 1-4, the inner face 106 and outer face 108 each extend at a taper angle θ relative to the axial direction A, such that the sidewall 102 forms a frustoconical shape that grows in the radial direction as a function of height. Thus, the refractory ring 100 is wider at the top than at the bottom. As will be appreciated from the illustration of FIG. 4, the inner face 106 and outer face 108 may taper in a stepwise fashion, with the faces of each individual brick being parallel to the axial direction, but the bricks being stacked at progressively greater distances from the center axis 104. The value of the taper angle θ may be selected according to conventional refractory system requirements, as will be understood by persons of ordinary skill in the art.

In a typical case, the outer face 108 of the refractory ring 100 preferably is dimensioned and shaped to fit within a corresponding outer refractory liner of a ladle to form a conventional two-layer ladle lining. The outer face 108 may be dimensioned and shaped to contact the outer refractory liner at one or more locations, or it may be dimensioned and shaped to be spaced from the outer refractory liner, with a predetermined gap between the outer face 108 and the outer refractory liner. The provision of such a gap permits an intermediate material (e.g. bonding or packing material, intermediate insulating material, and so on) to be placed between the refractory ring 100 and the outer refractory liner. The gap also helps assure that the ring 100 can be properly fit within the outer refractory liner if the dimensions of the outer refractory liner are outside expected specifications.

The refractory ring 100 also includes lifting lugs 114 distributed around the center axis 104, which are used for lifting and moving the refractory ring 100. Each lifting lug 114 extends from the inner face 106 towards the center axis 104, and has a lower lug face 116 and a backing structure 118 extending upwards along the axial direction A from the lower lug face 116 towards the upper axial face 112. As best shown in FIG. 4, the lifting lugs 114 are located, along the axial direction A, between the lower axial face 110 and the upper axial face 112, and preferably are spaced from the lower axial face 110 to allow access to the lower lug face 116 if the refractory ring 100 is placed on a flat surface. The lower lug faces 116 preferably are all positioned in a single plane and at the same elevation, but this is not strictly required.

As shown in FIG. 3, the lifting lugs 114 may be distributed equidistantly around the center axis. In this case, there are four lifting lugs 114 spaced at equal 90 degree intervals. However, such equidistant spacing is not strictly required. For example, other embodiments may have uneven spacing in order to place one or more of the lifting lugs 114 out of the path of incoming molten metal material, or to modify the liquid flow dynamics within the ladle. It is also not necessary to have four lifting lugs 114. For example, two lifting lugs 114 on opposite sides of the ring 100 may be removed, leaving two lifting lugs 114 that may be used to lift and move the ring 100.

In the example of FIGS. 1-4, the lifting lugs 114 are formed by bricks that protrude radially inward from the remainder of the inner face 106 of the sidewall 102. In some embodiments, each lifting lug 114 may be formed by a single brick, but in the shown embodiment, each lifting lug 114 is formed by one or more lower lug bricks 120 and one or more upper backing bricks 122. Each backing brick 122 is located immediately above and in contact (directly or via a connecting structure such as a layer of epoxy, mortar or other adhesive) with one or more of the lug bricks 120.

Figure 2:
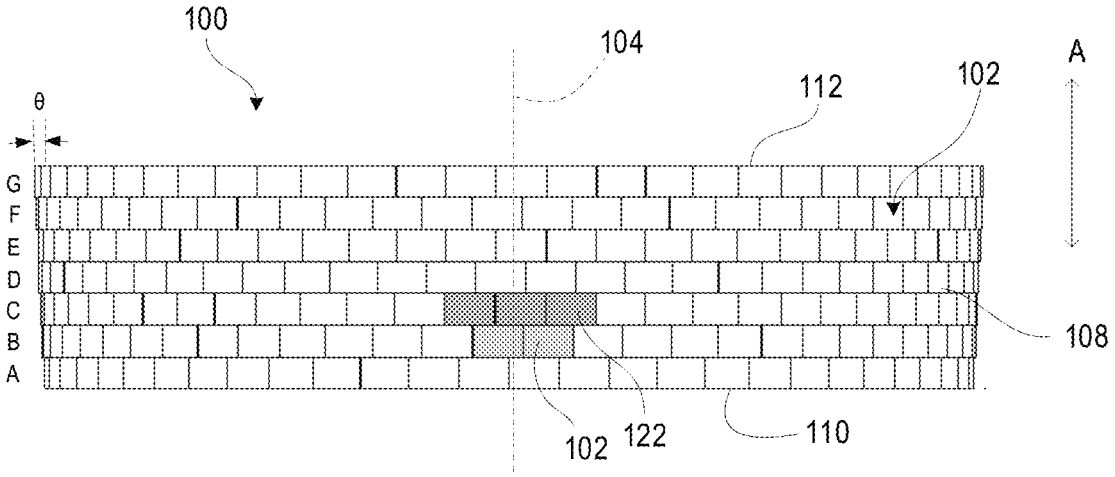
FIG. 2 is an elevation view of the refractory ring of FIG. 1.

As best shown in FIG. 2, the lug bricks 120 and backing bricks are formed as portions of respective brick layers A, B, C, etc. that collectively form the ring 100. The lug bricks 120 and backing bricks 122 preferably have the same heights in the axial direction as the remainder of the bricks forming their respective brick layer, which minimizes assembly difficulty and the need for unique brick sizes. In this example, there are seven brick layers. Layer A is the bottom-most layer, and Layer G is the top-most layer. Layer B incorporates the lower lug brick 120, and is referred herein as a lifting brick layer B. Layer C incorporates the upper backing bricks 122, and is referred to herein as a backing brick layer C. Layers D, E and F are located between the backing brick layer C and the top-most layer G. In other cases, one or more layers may be omitted. For example, one or more of layers C through F may be omitted. One or more of the layers also may be replaced by a monolithic ring-shaped casting of refractory material. For example, layers D through G may be replaced by a single cast layer. Other alternatives and variations will be apparent to persons of ordinary skill in the art in view of the present disclosure.

Figure 5:
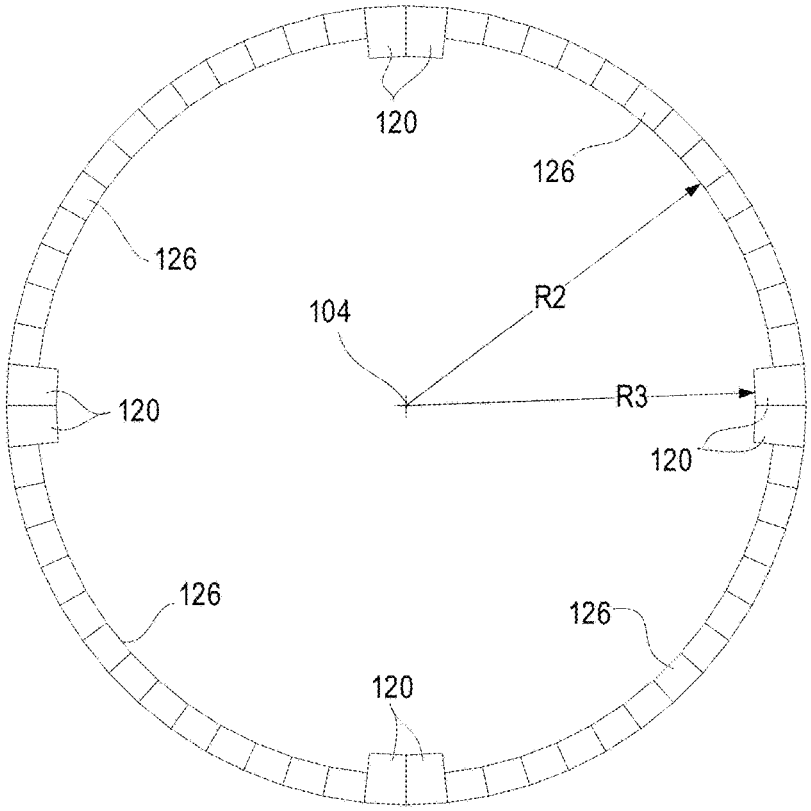
FIG. 5 is a top plan view of a lifting brick layer of the embodiment of FIG. 1.
Figure 6:
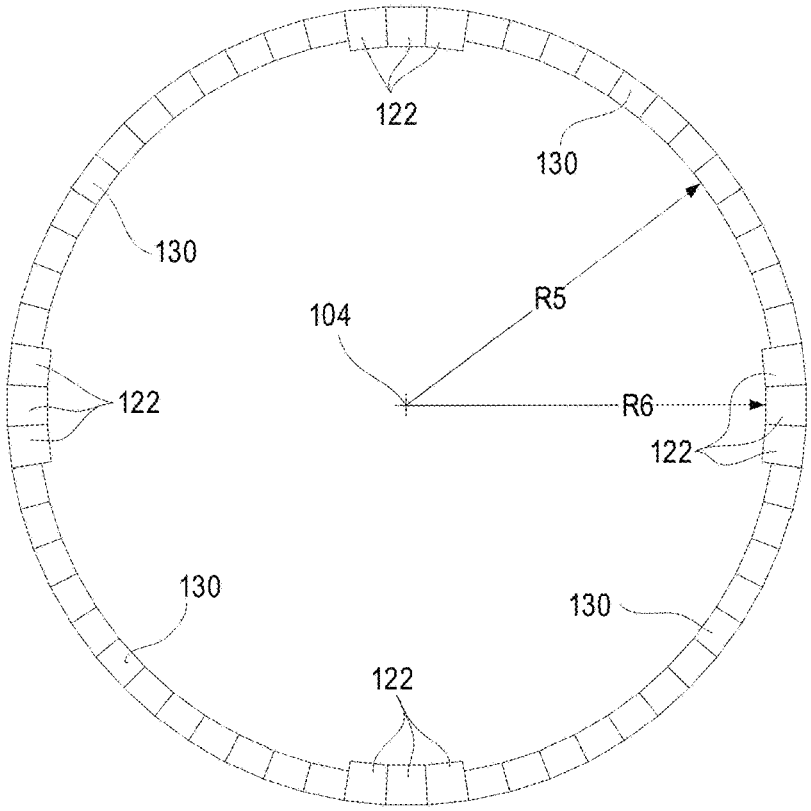
FIG. 6 is a top plan view of a backing brick layer of the embodiment of FIG. 1.

Exemplary geometric relationships between the different bricks in the different layers are illustrated in FIGS. 4 through 6. As shown in FIG. 4, the lower brick layer A is defined by a ring of lower bricks 124 that are arranged at a first distance R1 from the center axis 104. That is, the nearest point of each lower brick 124 is spaced from the center axis 104 by the first distance R1. The lifting brick layer B is located above the lower brick layer A with respect to the axial direction A, and is defined by a plurality of lifting layer sidewall bricks 126 arranged in two or more groups at a second distance R2 from the center axis 104, and a plurality of lug bricks 120 arranged in two or more groups at a third distance R3 from the center axis. Each group of lug bricks 120 is located between a respective two of the groups of lifting layer sidewall bricks 126. In this case, there are four groups of lug bricks 120 having two lug bricks 120 in each group, and these groups are interposed between respective pairs of four groups of lifting layer sidewall bricks 126. The upper brick layers D through G are located above the lifting brick layer B with respect to the axial direction A, and each upper brick layer is defined by a ring of upper bricks 128 arranged at a respective fourth distance R4, R4', R4", R4'" from the center axis 104. In this case, R4 is greater than R3, and the upper brick layers have progressively increasing radial distances (i.e., R4<R4'<R4"<R4'"). In other cases, one or more of the upper brick layers may have the same radial distance as the layer below it (i.e., R4≤R4'≤R4"≤R4'"). In some cases, an upper layer also may have a smaller radial distance than the layer below it (see, e.g., FIG. 17).

As shown in FIG. 5, the third distance R3 is less than the second distance R2, such that each lug brick 120 extends radially inward from the remaining lifting layer sidewall bricks 126. In addition, as shown in FIG. 4, the third distance R3 is less than the first distance R1, such that each lug brick 120 extends radially inward from the lower bricks 124. Thus, each lug brick 120 extends in the radial direction from a respective embedded end 120' that is embedded in the sidewall 102, to a respective cantilevered end 120" that extends a first distance (i.e., R3-R1) from the lower adjacent portion of the inner face 106 of the sidewall 102. The cantilevered end 120" forms at least a portion of the backing structure 118 of the lug 114, and the lower lug face 116 is formed by the exposed lower surface of the cantilevered end 120".

The particular geometry of the lower lug face 116 may be selected as necessary to engage an associated lifting device. For example, each lower lug face 116 may be flat and lie in a plane that extends orthogonally to the axial direction A. In the embodiment of FIG. 4, each lower lug face 116 also extends perpendicular to the adjacent portion of the inner face 106, but this is not strictly required (as an alternative, see the embodiment of FIG. 9).

The embedded end 120' of the lug brick 120 may extend to be flush with the outer face 108 of the sidewall 102, such as shown in FIGS. 4 and 5. This provides stable securement and a continuous outer face 108, but requires the use of a lug brick 120 having a different geometry than the lifting layer sidewall bricks 126. This construction is not strictly required, and other embodiments may use lug bricks 120 that are identical to the lifting layer sidewall bricks 126 in shape and size, or that have other shapes and sizes.

The first distance R1, second distance R2 and fourth distance R4 may be selected to provide different ring profile shapes. In the example of FIG. 4, the first distance R1 is less than the second distance R2, and the second distance R2 is less than the fourth distance R4 of the lowermost upper layer D. Thus, the lower layer A, lifting brick layer B and lowermost upper layer D form a conical shape. Additional layers, such as the backing brick layer C (if used) and other upper layers E, F, G may have similar varying dimensions to form a continuous stepped conical shape, such as shown. In other cases, the first distance R1, second distance R2 and fourth distances R4 may be equal, to form a cylindrical profile. Other configurations may be used in other cases.

The exemplary backing brick layer C is located between the lifting brick layer B and the lowermost upper brick layer D. The backing brick layer C is defined by a plurality of backing layer sidewall bricks 130 arranged in two or more groups at a fifth distance R5 from the center axis 104, and a plurality of backing bricks 122 arranged in two or more groups at a sixth distance R6 from the center axis 104. Each group of backing bricks 122 is located between a respective two groups of backing layer sidewall bricks 130. The backing bricks 122 are in direct contact with at least one of the plurality of lug bricks (i.e., brick-to-brick contact or contact via an adhesive or bonding layer). Thus, the backing bricks 122 buttress the lug bricks 120 against vertical loads.

The sixth distance R6 is less than the fifth distance R5, and greater than the third distance R3. Thus, each backing brick 122 extends radially inward from the adjacent backing layer sidewall bricks 130, but does not extend inward as far as the lug bricks 120. In this configuration, each lug 114 is formed by a connected group of lug bricks 120 and backing bricks 122. The lug bricks 120 form a lower portion of the lug backing structure 118. This lower portion extends upwards from the lower lug face 116, and inwards a first distance (R3-R1) from a lower adjacent portion of the inner surface 106. The backing bricks 122 form an upper portion of the lug backing structure 118, and this second portion extends a second distance from the inner surface, with the second distance being less than the first distance. The radially-innermost portions of the first portion formed by the lug bricks 120 and the second portion formed by the backing bricks 122 are parallel to adjacent portions of the inner surface 106, to thereby form a backing structure 118 having a stepped shape, as shown in FIG. 4.

The configuration of lug bricks 120 and backing bricks 122 may be selected to enhance the load-bearing capacity of the lug 114. For example, in the shown embodiment, each group of backing bricks 122 is centered on the adjacent group of lug bricks 120, and subtends a larger angle, as viewed along the axial direction A, than the adjacent group of lug bricks 120. Such an arrangement can be readily formed by, for example, positioning three backing bricks 122 over two lug bricks 120, with each lug brick 120 contacting two adjacent backing bricks 122. Thus, the backing bricks 122 are positioned to distribute vertical forces applied to the lower lug face 116 both vertically and laterally to spread such loads across a greater number of upper layer bricks 130. In other cases, multiple backing brick layers C may be vertically stacked, with the respective backing bricks 122 of each layer being positioned to buttress the backing bricks 122 of the lower layer against vertical loads. Other alternatives and variations will be apparent to persons of ordinary skill in the art in view of the present disclosure.

Figure 7:
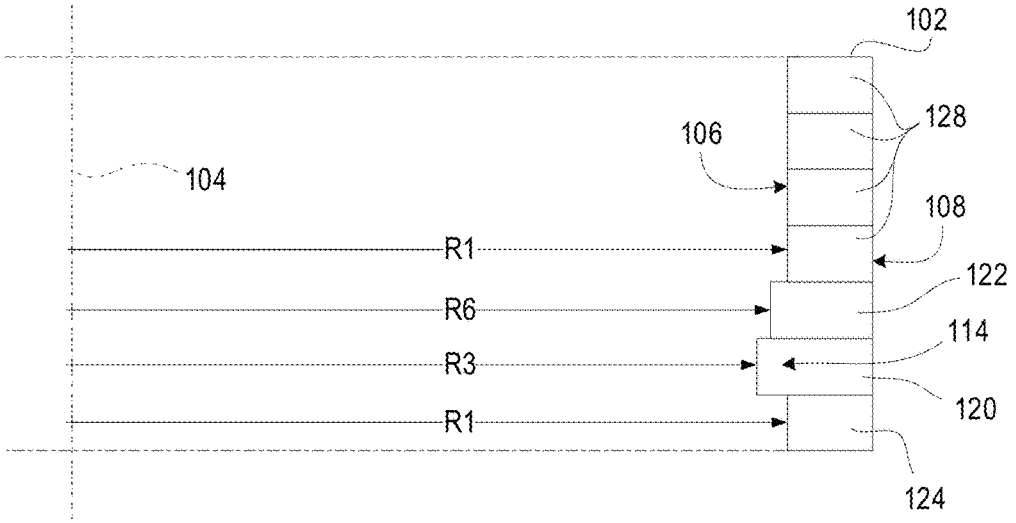
FIG. 7 is a partial section view of another exemplary embodiment of a refractory ring showing a portion of the sidewall in elevation view, with background removed.

FIGS. 7 through 10 show various alternative embodiments of sidewall and lug structures. In FIG. 7, the sidewall 102 is formed similarly to the embodiment of FIGS. 4-6, however, the lower bricks 124, lifting layer sidewall bricks 126, upper bricks 128 and backing layer sidewall bricks 130 are all positioned at the same distance R1 from the center axis 104. Thus, the inner face 106 of the sidewall 102 forms a cylindrical shape. The bricks also may be configured such that the outer face 108 also forms a cylindrical shape, but this is not required.

Figure 8:
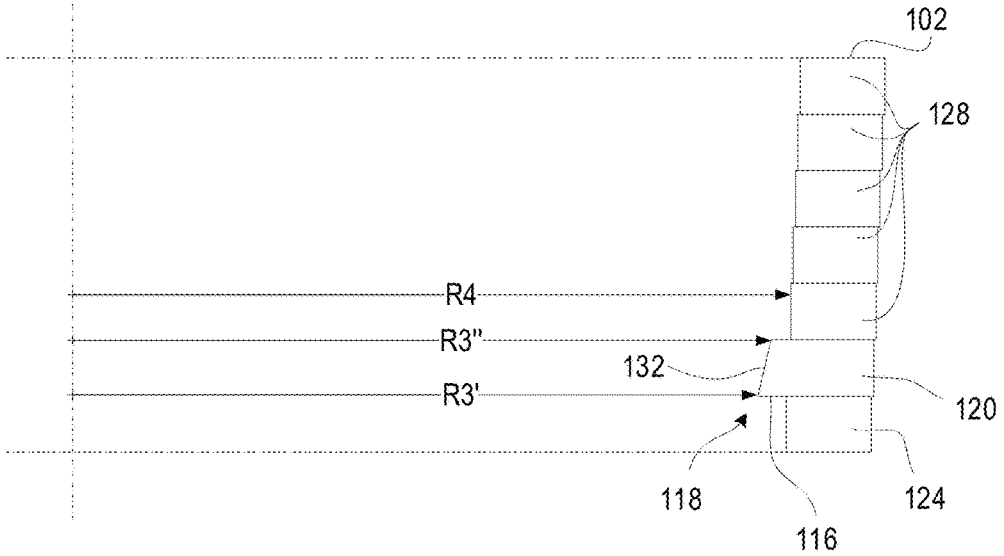
FIG. 8 is a partial section view of another exemplary embodiment of a refractory ring showing a portion of the sidewall in elevation view, with background removed.

The embodiment of FIG. 8 is also similar to that of FIGS. 4-6, but, in this case, the backing layer is omitted and replaced by another upper layer. In addition, the lug bricks 120 of this or other embodiments optionally may have tapered inner faces 132 that vary from a relatively small third distance R3' at a lower edge adjacent to the lower lug face 116, to a relatively large third distance R3" at an upper edge opposite the lower lug face 116. Thus, the lug bricks 120 form a backing structure that tapers towards the inner face 106 as the lug 114 extends upwards. This configuration may reduce wear and turbulence as molten metal strikes the lug 114.

Figure 9:
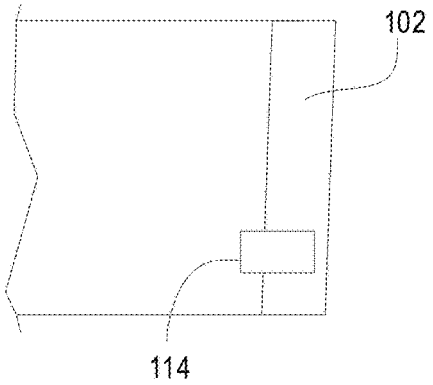
FIG. 9 is a partial section view of another exemplary embodiment of a refractory ring showing a portion of the sidewall in elevation view.

FIG. 9 shows another embodiment in which the sidewall 102 comprises a monolithic structure formed, for example, by a cast refractory material. The lifting lugs 114 are formed separately from the sidewall 102. The lifting lugs 114 may be cast in place in the desired locations by forming openings or pockets in the sidewall 102 to receive the lugs 114, then casting the lifting lugs into a mold placed over such pockets or openings. Alternatively, the sidewall 102 may be cast with the pocket during the molding process, or later machined to create the pocket, and a preformed lug 114 may be inserted into the pocket. As another example, the lifting lugs 114 may be pre-formed and the sidewall 102 molded around the lifting lugs 104.

Figure 10:
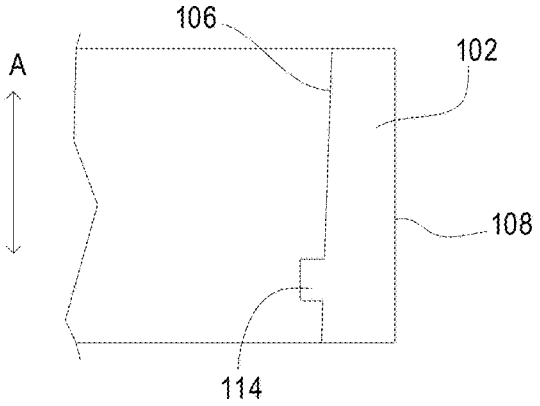
FIG. 10 is a partial section view of another exemplary embodiment of a refractory ring showing a portion of the sidewall in elevation view.

FIG. 10 shows an embodiment in which the sidewall 102 and lug 114 are monolithically formed together as a single part. FIG. 10 also shows the inner face 106 being tapered, and the outer face 108 being cylindrical. Here, the lug 114 extends orthogonally to the axial direction A, but the lower and upper faces of the lug 114 are angled relative to the immediately adjacent portions of the inner face 106. extends at an acute angle In other cases, the outer face 108 may be tapered, and the inner face 106 cylindrical.

FIGS. 11-13 show further variations in the number, shape and position of the lugs 114 relative to the sidewall 102. In FIG. 11, there are three lugs 114 centered at 120 degree angles from each other. In FIG. 12, there are two lugs 114 at 180 degrees from each other, and each lug 114 is relatively large. In FIG. 13, there is a single lug 114, which may extend entirely around the circumference of the ring 102, as shown, or it may extend around part of the circumference (e.g., a portion of the lug 114 may be omitted to allow unobstructed access for a lifting tool or metal flow). In the cases of FIGS. 12 and 13, each lug 114 may be used as multiple contact points for a lifting mechanism. For example, a lifting mechanism having three lifting arms may be positioned with two of the lifting arms in contact with one lug 114 of FIG. 12, and one lifting arm in contact with the other lug 114 of FIG. 12.

Two further variations on unitary refractory rings 100 are illustrated in FIGS. 14-17. These variations may be generally the same as the foregoing embodiments. For brevity only the differences are identified.

Figure 14:
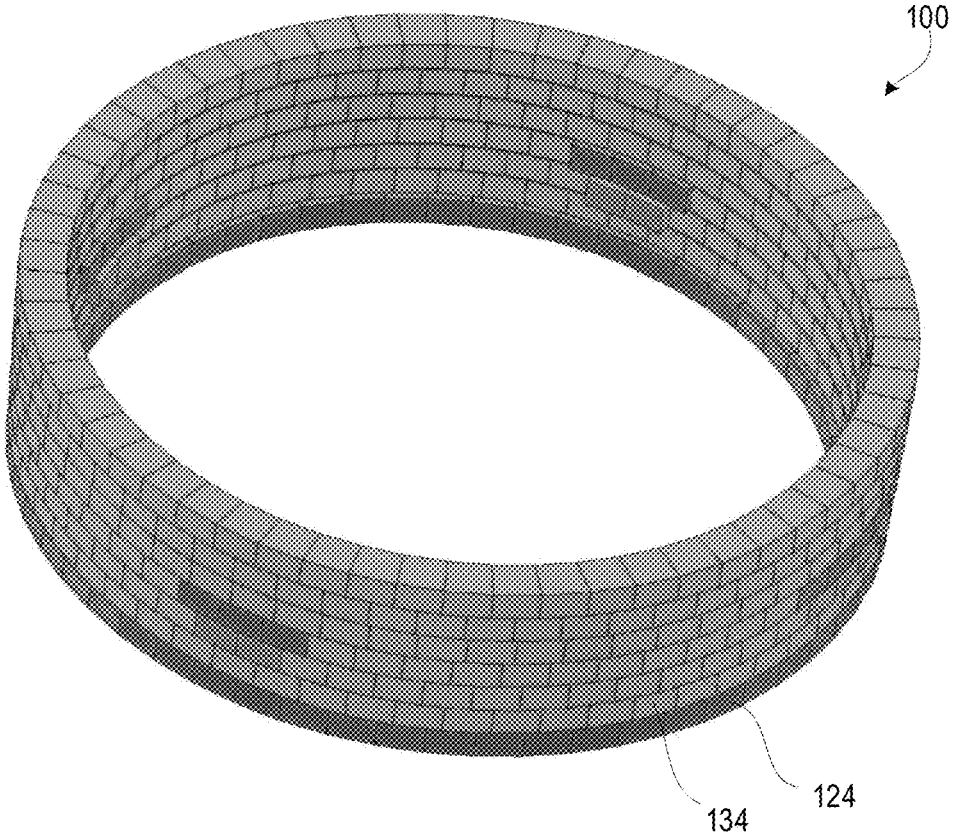
FIG. 14 is an isometric view of another exemplary embodiment of a unitary refractory ring.
Figure 15:
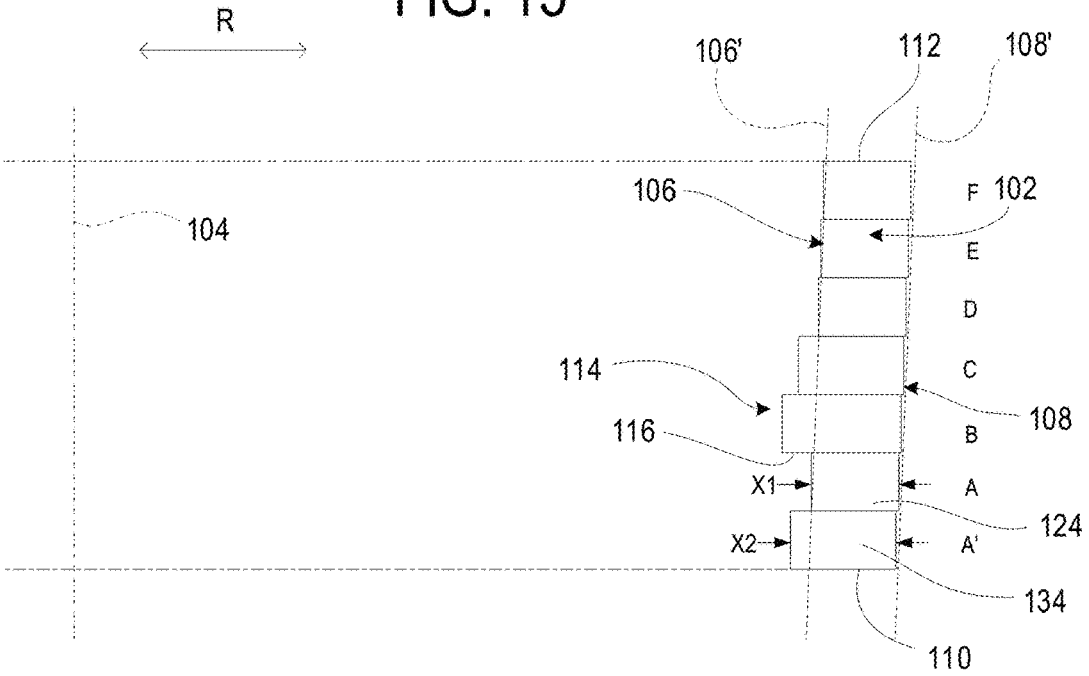
FIG. 15 is a partial section view of the refractory ring of FIG. 16 showing a portion of the sidewall in elevation view, with background removed.

In the embodiment of FIGS. 14 and 15, the refractory ring 100 omits the top-most upper layer G, and adds an additional bottom layer A' formed by bottom bricks 132 located below and attached to the previously-described lower layer A. The bottom layer A' is configured to distribute the load of the refractory ring 100 more than the lower layer A. Specifically, the lower bricks 124 have a first thickness X1 as measured along a radial direction R that is orthogonal to the center axis, and the bottom bricks 134 have a second thickness X2 as measured along the radial direction R, and the second thickness X2 is greater than the first thickness X1. Thus, the thicker bottom bricks 134 help distribute the weight of the refractory ring 100 to an underlying surface.

In the example of FIGS. 14 and 15, the bottom bricks 134 are positioned with their excess thickness extending radially inwards from the inner face profile 106'. In this case, the bottom layer A' preferably is spaced from the lifting brick layer B by the lower layer A to ensure that the entire lower lug face 116 is accessible to lifting equipment. In other cases, the lower layer A may be omitted, and other provisions made to ensure that the lower lug face 116 is suitably available for lifting the refractory ring 100. For example, the bottom bricks 132 immediately below the lug bricks 120 may be replaced by thinner bricks, or the bottom bricks 134 may be offset radially outwards from the outer face profile 108'. The bottom bricks 134 also may be partially offset both inwardly from the inner face profile 106' and outwardly from the outer face profile 108'. Other options will be apparent in view of the disclosures herein.

Figure 16:
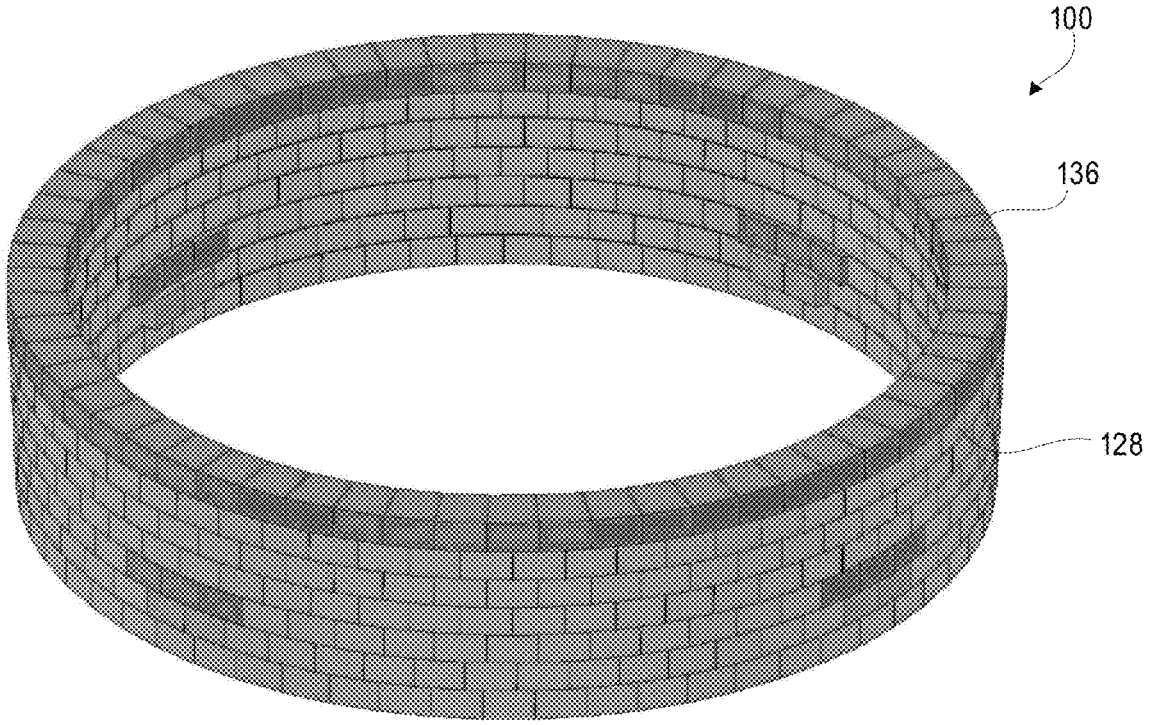
FIG. 16 is an isometric view of another exemplary embodiment of a unitary refractory ring.
Figure 17:
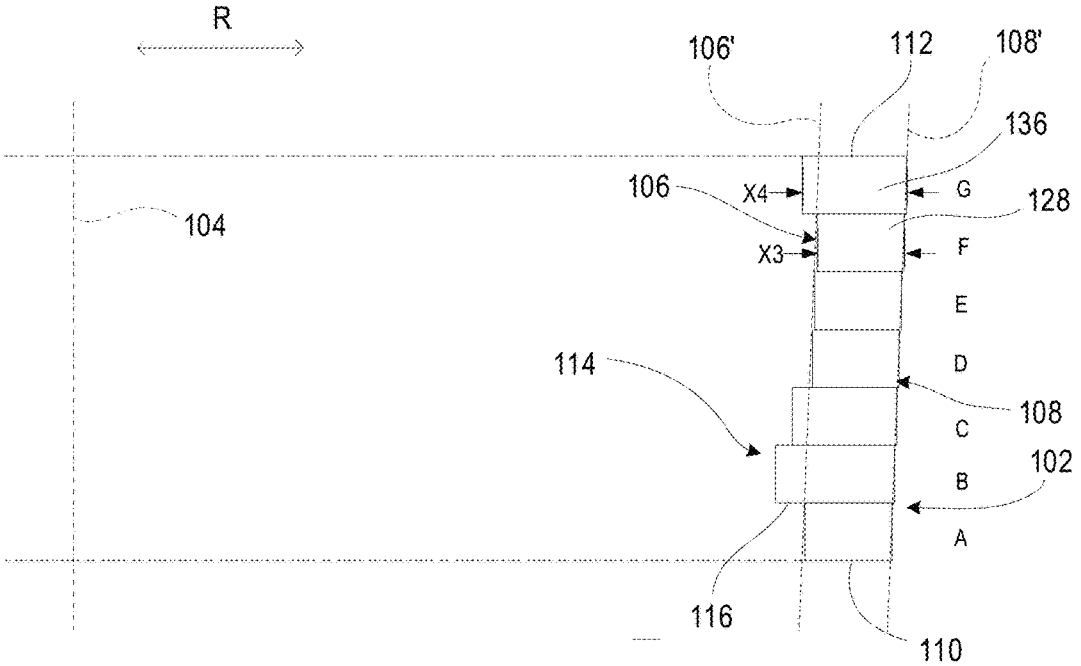
FIG. 17 is a partial section view of the refractory ring of FIG. 16 showing a portion of the sidewall in elevation view, with background removed.

Referring now to FIGS. 16 and 17, this embodiment of a refractory ring 100 has as top layer G formed by relatively thick top bricks 136. Specifically, the upper layer or layers D, E, F are formed by upper bricks 128 having a third thickness X3 in the radial direction R, and the top bricks 136 have a fourth thickness X4 in the radial direction, with the fourth thickness X4 being greater than the third thickness X3. Thus, the top layer G is suited to concentrate weight from above to the refractory ring 100. The extra thickness of the top bricks 136 also may be helpful to improve their durability if the top bricks 136 are within the slag line of the refractory ladle. As with the embodiment of FIGS. 1-6, this embodiment also preferably includes a lower layer A to provide space for a lifting device to engage the lower lug faces 116 when the refractory ring 100 is sitting on a flat surface. Also, as with the embodiment of FIGS. 14 and 15, the top bricks 136 may have their extra thickness offset inward from the inner face profile 106' or outward from the outer face profile 108', or both.

It will be appreciated that all of the foregoing variations may be used in any suitable combination with each other. For example, a ring 100 formed of laid bricks, such as shown in of FIGS. 1-6, may be formed with a tapered inner face 106 and a cylindrical outer face 108. As another example, the embodiments of FIGS. 14-17 are shown as being unitary refractory rings 100 formed by joined refractory bricks, but they may be constructed as described in relation to FIGS. 9 and 10. Other alternatives and variations will be apparent to persons of ordinary skill in the art in view of the present disclosure. Other alternatives and variations will be apparent to persons of ordinary skill in the art in view of the present disclosure.

Refractory rings 100 as discussed herein may be used in place of all or a portion of a conventional inner refractory lining formed by assembling individual bricks in place within the ladle itself. This allows more convenient, and potentially safer, assembly of the inner refractory liner, and can increase the replacement and repair speed. It is anticipated that multiple refractory rings 100 may be used in a single ladle. Such refractory rings 100 may be identical to each other, or have different constructions.

Figure 18:
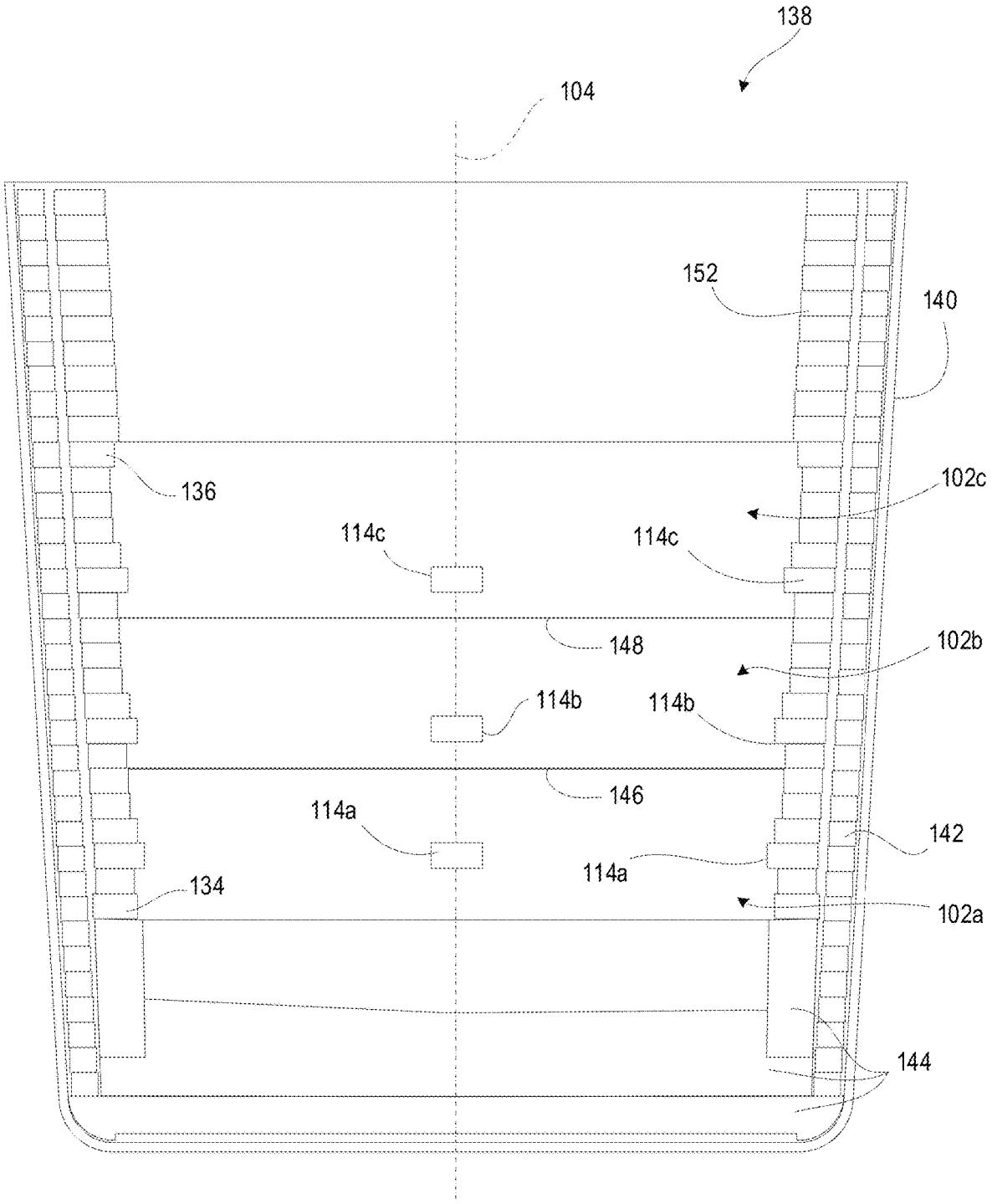
FIG. 18 is a cross-section elevation view of an exemplary embodiment of a ladle assembly incorporating an exemplary embodiment of a system of unitary refractory rings, shown with background simplified.
Figure 19:
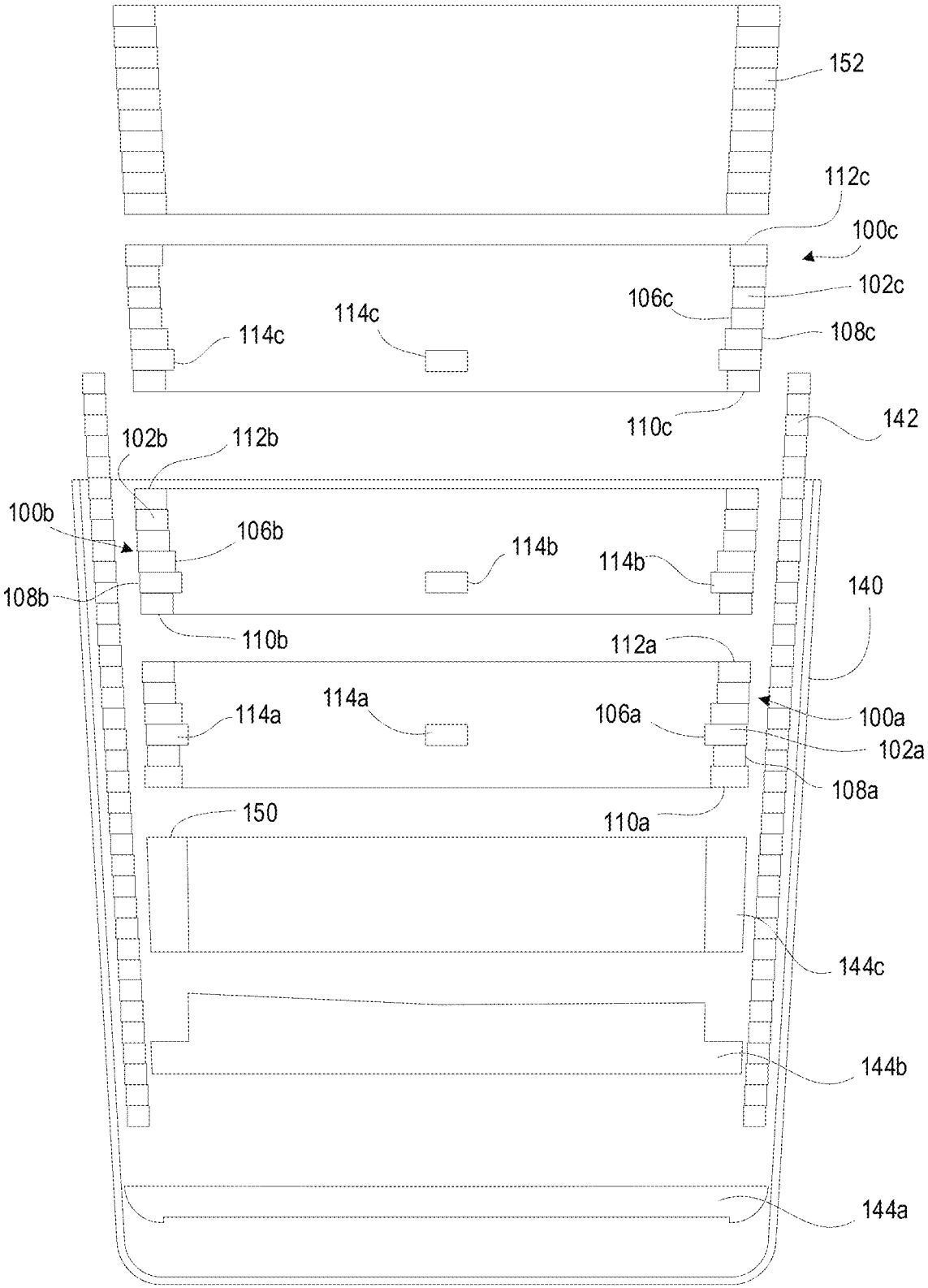
FIG. 19 is an exploded version of FIG. 18.

An example of a ladle 138 having multiple refractory rings 100*a*, 100*b*, 100*c* is shown in FIGS. 18 and 19. The ladle 138 comprises a conventional outer shell 140 of steel or other durable material, a conventional outer liner 142 formed by connected refractory bricks, and a conventional bottom liner 144 formed by one or more cast refractory structures. The inner liner is formed by a lower refractory ring 100*a* that is dimensioned to rest on the bottom liner 144, a middle refractory ring 100*b* that is dimensioned to rest on the lower refractory ring 100*a*, an upper refractory ring 100*c* that is dimensioned to rest on the middle refractory ring 100*b*, and a stack of slag line bricks 152 that are laid on top of the upper refractory ring 100*c*. Although three refractory rings 100*a*, 100*b*, 100*c* are shown, other embodiments may have one refractory ring, two refractory rings, or more than three refractory rings.

Each refractory ring 100 comprises a unitary structure having a respective sidewall 102 with a respective inner face 106 forming a continuous closed loop about a center axis 104. Each sidewall 102 is spaced from a center axis 104 and extends along the respective center axis 104 from a respective lower edge 110 to a respective upper edge 112. Each refractory ring 100 also includes a respective plurality of lifting lugs 114 distributed around the center axis 104 and extending from the respective inner face 106 towards the center axis 104.

The upper edge 112*a* of the first refractory ring 100*a* is configured to abut the lower edge 110*b* of the second refractory ring 100*b* to form a closed seam 146. Where a third refractory ring 100*c* is provided, the upper edge 112*b* of the second refractory ring 100*b* may be configured to abut the lower edge 110*c* of the third refractory ring 100*c* to form another closed seam 148. The closed seams 146, 148 may be filled with an epoxy adhesive or mortar to secure the first refractory ring 100*a* to the second refractory ring 100*b*, but this is not strictly required.

Similarly, the lower edge 110*a* of the first refractory ring 100*a* may rest directly on an upper surface 150 the refractory ladle bottom 144, and the upper edge 112*c* of the third refractory ring 100*c* (or the upper edge 112*b* of the second refractory ring 100*b*, if there is no third refractory ring 100*c*) may be configured to abut the stack of slag line bricks 152. The slag line bricks 152 may be provided as another unitary refractory ring, but more preferably are laid in place after the final refractory ring 100 is installed, due to the fact that incorporating protruding lifting lugs 114 into the slag line region could negatively affect fluid flow and might degrade rapidly during use.

The refractory rings 100 preferably are configured such that they can be connected to each other, and optionally also with the ladle bottom 144 and slag line bricks 152, in any relative angular orientation. For example, the upper edges 112 and lower edges 110 may lie in respective flat planes that are orthogonal to the center axis 104, such as shown in FIGS. 18 and 19 (see also FIGS. 4, 7-10 and 15 and 17). In this configuration, there are no protrusions or recesses in the upper or lower edges 112, 110. Thus, the upper edge 112 of a lower refractory ring 100 may be joined with the lower edge 110 of an upper refractory ring 100 at any angular orientation about the center axis 104. This simplifies the construction of the refractory rings 100 and their assembly into the ladle 138, and is expected to provide a significant benefit over preformed refractory rings having helical starter ramps for laying helical arrangements of bricks above or below the ring. Despite this, one or more of the refractory rings 100 may include such starter ramps or other features. For example, the uppermost refractory ring 100*c* may have helical starter ramps at the upper edge 112 to facilitate assembly of the slag line bricks 152 in place within the ladle 138.

FIGS. 18 and 19 also show a configuration of the lifting lugs 114, in which the lifting lugs 114 of each refractory ring 100 are positioned with their lower lug faces between the respective lower edge 110 and the respective upper edge 112. Thus, the lower lug faces are accessible even when the refractory ring 100 is positioned on a flat surface, such as an assembly room or factory floor.

Figure 20:
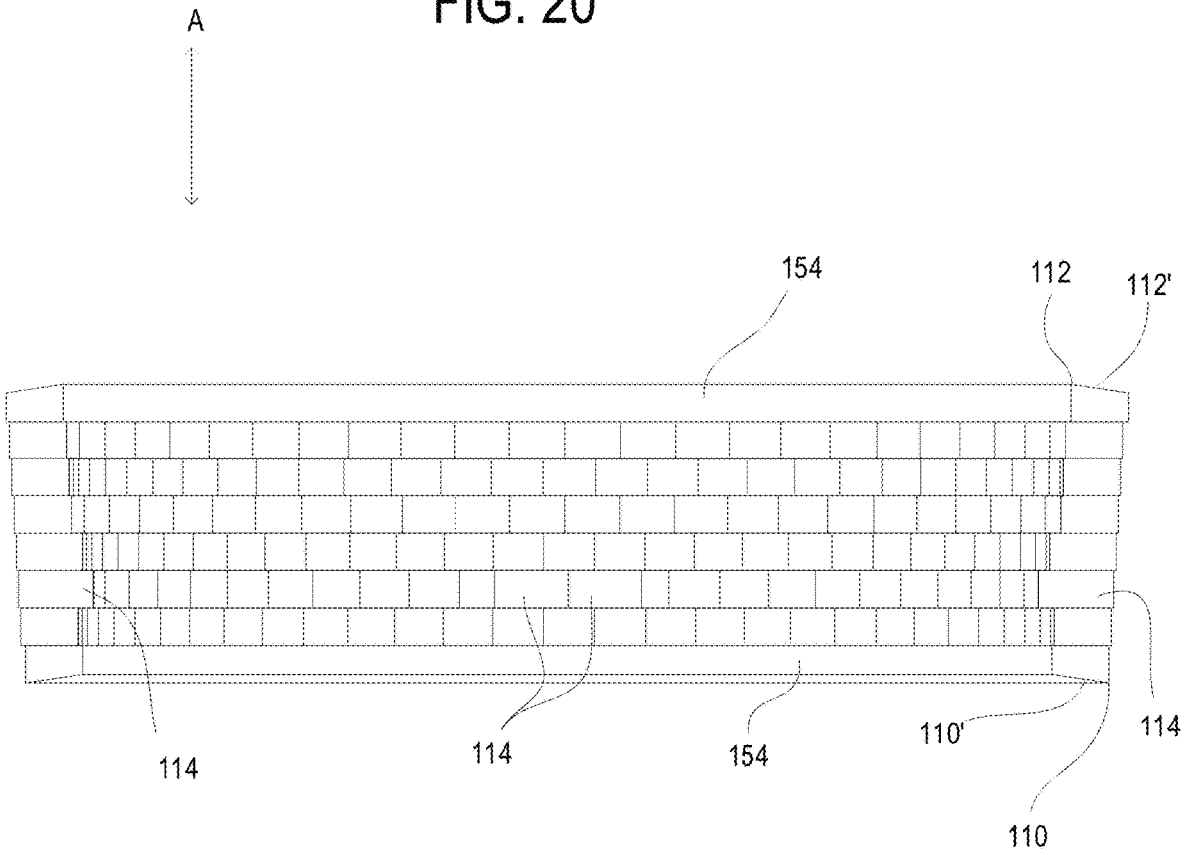
FIG. 20 is a cross-section elevation view of another exemplary embodiment of a refractory ring.

An alternative arrangement is shown in FIG. 20. Here, the upper edges 112 may be formed as the uppermost edge of an upper radially-tapered surface 112', and the lower edges 110 may be formed as the lowermost edge of a lower radially-tapered surface 110'. As used herein, a radially-tapered surface is a frustoconical surface that is tapered along the axial direction A as a function of radial distance from the center axis 104. This construction may be provided by adding precast ring layers 154 having the desired bevel to the tops and bottoms of adjacent brick refractory rings, by making the refractory ring sidewall 102 as a casting, such as shown in FIGS. 9 and 10, by machining a conical bevel on the upper and lower bricks of an assembled brick refractory ring, and so on. This construction provides a self-centering function during assembly, and also provides the benefit of allowing installation in any angular orientation.

The embodiment of FIGS. 18 and 19 has a tapered inner liner that transitions from a relatively small inside diameter at the ladle bottom 144 to a relatively large inside diameter at the slag line bricks 152. In this case, each refractory ring 100 may have different dimensions to form a continuous taper. In other embodiments, the inner surfaces 106 of the refractory rings 100 may have a cylindrical shape with a uniform inside diameter (see FIG. 7 as an example), in which case the refractory rings 100 may have identical constructions. Other alternatives and variations will be apparent to persons of ordinary skill in the art in view of the present disclosure. The refractory rings 100 in FIGS. 18 and 19 also may include variations such as enlarged bottom bricks 134 on the lower refractory ring 100*a*, and enlarged top bricks 136 on the upper refractory ring 100*c*.

Refractory ring systems, such as shown in FIGS. 18 and 19, may be assembled in any suitable order. For example, the ladle 138 may be prepared by installing a base portion 144*a* of the ladle bottom 144 into the shell 140, then laying the bricks to form the outer liner 142 using conventional methods, then installing an bottom plug 144*b*, and a bottom ring 144 to complete the ladle bottom 144. Next, the first refractory ring 100*a*, second refractory ring 100*b* and third refractory ring 100*c* are installed one at a time and in that order, by lifting and moving each refractory ring 100 using its respective lifting lugs 114. Finally, the slag line bricks 152 are installed in place on top of the third refractory ring 100*c* using conventional methods. Other embodiments may use other variations of ladle bottom constructions 144, or other assemblies of refractory rings 100.

During assembly, one or more of the first refractory ring 100*a*, second refractory ring 100*b*, and third refractory ring 100*c* may be installed at an arbitrary angular orientation about the center axis 104, thus simplifying and accelerating the installation process.

Embodiments of refractory rings 100 may be constructed using any suitable methods. For example, the refractory ring 100 of FIGS. 1-6 may be constructed by laying each individual brick and joining the bricks as each one is laid with all of the previously-laid adjacent bricks. This may be performed by forming the lower layer A until it is complete, then laying the lifting brick layer B until it is complete, then laying the remaining layers (e.g., the backing brick layer C if used and the upper layers D-G) one by one until the refractory ring 100 is full formed. Alternatively, the lifting brick layer B and other higher layers may be assembled before the lower layer is fully completed. As another alternative, each layer may be pre-assembled and then the layers joined. The bricks may be laid individually, or pre-assembled into connected groups. For example, an assembly of lug bricks 120 and backing bricks 122 may be pre-formed as a unit to be placed into the refractory ring 100. It is also anticipated that the individual bricks may be a laid and then connected after they are laid by activating a bonding agent placed between the bricks during the laying process. Other alternatives and variations will be apparent to persons of ordinary skill in the art in view of the present disclosure.

The bricks may comprise any suitable refractory materials, provided the materials, as assembled, have sufficient integrity to hold the refractory ring 100 in a unitary state during lifting and movement of the refractory ring 100 by the lugs 114. Similarly, the bricks forming the lugs 114 may include any refractory material having a modulus of rupture sufficient to prevent the material, as assembled, from breaking during lifting. The bricks also may comprise combinations of different refractory materials, such as by using one type of material for the lugs 114, and another type of material for the remaining bricks. A variety of different refractory materials are known in the art, and the selection of an appropriate material will be within the skill of the person of ordinary skill in the art without undue experimentation.

The bricks may be connected using any suitable adhesive, epoxy, mortar or the like, provided the connection has sufficient strength to allow the entire refractory ring 100 to be lifted and moved by the lugs 114. Such bonding materials are known in the art, and need not be described in detail herein. In one embodiment, the epoxy or other bonding material has shear strength that is equal to or greater than the shear strength of the bricks. The brick connecting process may be selected according to the bonding material. For example, when mortar is used, each brick may be dipped in a bath of the mortar or brushed with mortar prior to laying. As another example, when an epoxy bonding material is used, the epoxy may be injected in place on each brick as it is laid, and/or on previously-laid bricks to which the next brick is going to be placed. Other alternatives and variations will be apparent to persons of ordinary skill in the art in view of the present disclosure.

In one preferred embodiment, the bricks all have a similar truncated wedge-shaped construction, with the two converging sides of the wedge shape being oriented along lines that converge at a predetermined distance from the brick. Thus, the bricks can be laid with their converging sides adjacent each other to form a ring of a predetermined size. The ring size can be modified by changing the orientation of the wedge angle, or by laying the bricks with slight gaps between them to change the overall diameter of the ring. As shown in FIGS. 5 and 6, the lug bricks 120 and backing bricks 122 (if used) may be generally identical to the remaining bricks, with the exception being that they have a larger the radial dimension. For example, the lug bricks 120 may have a radial dimension of 8 inches, the backing bricks 122 may have a radial dimension of 7 inches, and the remaining bricks 124, 126, 128, 130 may have a radial dimension of 6 inches. In some cases, one or more bricks may be cut to form a layer having the desired diameter dimension.

It is expected that embodiments as described herein will provide significant benefits in facilitating the assembly of unitary refractory rings, and the installation of unitary refractory rings into a ladle. When manufactured from individual bricks, the shape and size of the refractory ring 100 can be readily adjusted as necessary to fit different installation requirements. The use of individual bricks also allows the use of different bricks in different locations, as needed to address different operating conditions (e.g., different bricks at the slag line or as the lug bricks). The use of lifting lugs that project radially inwards removes the need for creating openings in the sidewall to receive a lifting mechanism, and this helps reduce the generation of stress in the sidewall and avoids creating pockets of inhibited flow where molten metal can recirculate in isolation from the remaining contents of the ladle. Other benefits will be apparent from this disclosure and practice of embodiments.

The present disclosure provides examples of embodiments of unitary refractory rings and methods for making them and assembling them into ladles. It will be appreciated that embodiments may be modified in various ways, such as described herein or as might otherwise be determined during practice, and such modifications are intended to be included within the scope of this disclosure. Features of any given embodiment described herein may be used in isolation from other features of that embodiment, or in combination with features of other embodiments. Other alternatives and variations will be apparent to persons of ordinary skill in the art in view of the present disclosure.

The invention claimed is:

1. A unitary refractory ring comprising:

a sidewall forming a continuous closed loop about a center axis extending in an axial direction, the sidewall being spaced from the center axis in a radial direction that is perpendicular to the axial direction, and having an inner face facing towards the center axis, and an outer face facing away from the center axis, the inner face and the outer face extending in the axial direction between a lower axial face at a bottom of the sidewall, and an upper axial face at a top of the sidewall wherein the sidewall is configured to prevent passage of molten material through the inner face to the outer face between the lower axial face and the upper axial face, and wherein the lower axial face faces downward when the center axis is oriented vertically; and one or more lifting lugs distributed around the center axis and extending from the inner face towards the center axis at respective locations along the axial direction between the lower axial face and the upper axial face, each of the one or more lifting lugs comprising a lower lug face extending radially towards the center axis from the inner face and facing downward when the center axis is oriented vertically, and a backing structure extending upwards along the axial direction from the lower lug face towards the upper axial face;

wherein the one or more lifting lugs are configured to support the weight of the unitary refractory ring when the center axis is oriented vertically, by contact with the respective lower lug face of each of the one or more lifting lugs.

2. The unitary refractory ring of claim 1, wherein at least a portion of the inner face or the outer face extends parallel to the axial direction to form a cylindrical shape.

3. The unitary refractory ring of claim 1, wherein at least a portion of the inner face or the outer face extends at an angle to the axial direction to form a frustoconical shape.

4. The unitary refractory ring of claim 1, wherein the one or more lifting lugs comprises a plurality of lifting lugs distributed equidistantly around the center axis.

5. The unitary refractory ring of claim 1, wherein the backing structure of at least one lifting lug comprises a first portion adjacent to the lower lug face that extends a first distance from the inner surface, and a second portion between the first portion and the upper axial face that extends a second distance from the inner surface, the second distance being less than the first distance.

6. The unitary refractory ring of claim 5, wherein the first portion and the second portion extend parallel to a portion of the inner surface that is adjacent to the at least one lifting lug to thereby form a stepped structure.

7. The unitary refractory ring of claim 5, wherein the first portion comprises at least one first refractory brick partially embedded in the sidewall, and the second portion comprises at least one second refractory brick partially embedded in the sidewall.

8. The unitary refractory ring of claim 1, wherein at least one lifting lug comprises at least one first refractory brick that extends in the radial direction from a respective embedded end that is embedded in the sidewall to a respective cantilevered end that extends a first distance from an adjacent portion of the inner face of the sidewall to form the backing structure, wherein the lower lug face comprises a lower surface of the cantilevered end.

9. The unitary refractory ring of claim 8, wherein the embedded end of the refractory brick extends to and is flush with the outer face of the sidewall.

10. The unitary refractory ring of claim 8, wherein the sidewall comprises a monolithic structure to which the at least one first refractory brick is attached.

11. The unitary refractory ring of claim 8, wherein the sidewall comprises a plurality of second refractory bricks to which the at least one first refractory brick is attached.

12. The unitary refractory ring of claim 11, wherein the at least one refractory brick comprises a different refractory composition than the plurality of second refractory bricks.

13. The unitary refractory ring of claim 1, wherein at least one lifting lug comprises:

one or more lower lug bricks extending a first distance from the inner surface; and one or more upper lug bricks located between the one or more lower lug bricks and the upper axial face, extending a second distance from the inner surface, with the one or more upper lug bricks being in contact with at least one of the one or more lower lug bricks.

14. The unitary refractory ring of claim 13, wherein the second distance is less than the first distance.

15. The unitary refractory ring of claim 13, wherein the one or more lower lug bricks comprises two lower lug bricks, and the one or more upper lug bricks comprises three upper lug bricks.

16. The unitary refractory ring of claim 1, wherein at least one lifting lug is monolithically formed with the sidewall.

17. The unitary refractory ring of claim 1, wherein the sidewall and the one or more lifting lugs are formed by interconnected refractory bricks.

18. The unitary refractory ring of claim 17, wherein the sidewall and the one or more lifting lugs comprises:

a lower brick layer defined by a ring of lower bricks arranged at a first distance from the center axis and defining a respective portion of the sidewall;

a lifting brick layer located above the lower brick layer with respect to the axial direction, the lifting brick layer being defined by:

one or more lifting layer sidewall bricks arranged in one or more groups at a second distance from the center axis and defining respective portions of the sidewall, and one or more lug bricks arranged in one or more groups at a third distance from the center axis and defining the one or more lifting lugs, wherein the third distance is less than the second distance and the first distance, and wherein each of the one or more groups of lug bricks is located adjacent to a respective one of the one or more groups of lifting layer sidewall bricks; and an upper brick layer located above the lifting brick layer with respect to the axial direction, the upper brick layer being defined by a ring of upper bricks arranged at a fourth distance from a center axis and defining a respective portion of the sidewall.

19. The unitary refractory ring of claim 18, wherein the first distance is less than the second distance, and the second distance is less than the fourth distance.

20. The unitary refractory ring of claim 18, further comprising a backing brick layer located between the lifting brick layer and the upper brick layer, the backing brick layer being defined by:

one or more backing layer sidewall bricks arranged in one or more groups at a fifth distance from the center axis and defining respective portions of the sidewall; and one or more backing bricks arranged in one or more groups at a sixth distance from the center axis;

wherein the sixth distance is less than the fifth distance, and greater than the third distance; and wherein each of the one or more groups of backing bricks are located adjacent to a respective one of the one or more groups of backing layer sidewall bricks and in direct contact with at least one of the one or more lug bricks.

21. The unitary refractory ring of claim 18, wherein:

the one or more lifting layer sidewall bricks comprises a plurality of lifting layer sidewall bricks arranged in two or more groups at the second distance from the center axis, and the one or more lug bricks comprises a plurality of lug bricks arranged in two or more groups at the third distance from the center axis; and each of the two or more groups of lug bricks is located between a respective two of the two or more groups of lifting layer sidewall bricks.

22. The unitary refractory ring of claim 18, wherein the lower bricks have a first thickness as measured along a radial direction that is orthogonal to the center axis, and the refractory ring further comprises:

a bottom brick layer defined by a ring of bottom bricks arranged below and connected to the lower brick layer, wherein the bottom bricks have a second thickness as measured along the radial direction, the second thickness being greater than the first thickness.

23. The unitary refractory ring of claim 18, wherein the upper bricks have a third thickness as measured along a radial direction that is orthogonal to the center axis, and the refractory ring further comprises:

a top brick layer defined by a ring of top bricks arranged above and connected to the upper brick layer, wherein the top bricks have a fourth thickness as measured along the radial direction, the fourth thickness being greater than the third thickness.

24. A method for assembling a unitary refractory ring, the method comprising:

forming a lower brick layer defined by a ring of lower bricks arranged at a first distance from a center axis;

forming a lifting brick layer located above the lower brick layer with respect to an axial direction parallel to the center axis, the lifting brick layer being defined by:

one or more lifting layer sidewall bricks arranged in one or more groups at a second distance from the center axis, and one or more lug bricks arranged in one or more groups at a third distance from the center axis, wherein the third distance is less than the second distance and the first distance, and wherein each of the one or more groups of lug bricks is located adjacent to a respective one of the one or more groups of lifting layer sidewall bricks;

forming an upper brick layer located above the lifting brick layer with respect to the axial direction, the upper brick layer being defined by a ring of upper bricks arranged at a fourth distance from a center axis; and joining the lower bricks, lifting layer sidewall bricks, lug bricks and upper bricks together to form a unitary structure.

* * * * *